US012522463B2

(12) United States Patent
Hanamoto

(10) Patent No.: US 12,522,463 B2
(45) Date of Patent: Jan. 13, 2026

(54) POSTPROCESSING APPARATUS AND IMAGE FORMING APPARATUS

(71) Applicant: KYOCERA Document Solutions Inc., Osaka (JP)

(72) Inventor: Katsuhiko Hanamoto, Osaka (JP)

(73) Assignee: Kyocera Document Solutions, Inc. (JP)

( * ) Notice: Subject to any disclaimer, the term of this patent is extended or adjusted under 35 U.S.C. 154(b) by 43 days.

(21) Appl. No.: 18/641,283

(22) Filed: Apr. 19, 2024

(65) Prior Publication Data

US 2024/0351815 A1 Oct. 24, 2024

(30) Foreign Application Priority Data

Apr. 24, 2023 (JP) ..... 2023-071157

(51) Int. Cl.
*B65H 29/22* (2006.01)
*B65H 31/02* (2006.01)

(52) U.S. Cl.
CPC ..... *B65H 29/22* (2013.01); *B65H 31/02* (2013.01); *B65H 2404/1521* (2013.01); *B65H 2513/51* (2013.01)

(58) Field of Classification Search
CPC ..... B65H 29/22; B65H 2404/1521; B65H 5/36; B65H 31/02; B65H 31/36; B65H 2513/51
See application file for complete search history.

(56) References Cited

U.S. PATENT DOCUMENTS 9,016,681 B2 * 4/2015 Mizubata ..... G03G 15/6552 270/58.11
2020/0071116 A1 3/2020 Egawa
2021/0070079 A1 * 3/2021 Kim ..... B42C 1/12

FOREIGN PATENT DOCUMENTS

JP 2020-033156 3/2020

* cited by examiner

*Primary Examiner* — Howard J Sanders

(57) ABSTRACT

A postprocessing apparatus includes a processing tray on which a print sheet as a target of a postprocess is put, a stopper guide with which the print sheet on the processing tray makes contact, an intermediate roller, a registration mechanism, a guide mechanism, a driving device of the registration mechanism, and a transmission mechanism. The intermediate roller is configured to transport the print sheet. The registration mechanism is configured to move the incoming print sheet transported by the intermediate roller onto the processing tray and align print sheets on the processing tray. The guide mechanism is configured to guide the print sheet moved by the registration mechanism toward the stopper guide. The transmission mechanism is configured to transmit driving force of the driving device to the guide mechanism with a delay.

4 Claims, 8 Drawing Sheets

POSTPROCESSING APPARATUS AND IMAGE FORMING APPARATUS

CROSS-REFERENCE TO RELATED APPLICATIONS

This application relates to and claims priority rights from Japanese Patent Application No. 2023-071157, filed on Apr. 24, 2023, the entire disclosures of which are hereby incorporated by reference herein.

BACKGROUND

1. Field of the Present Disclosure

The present disclosure relates to a postprocessing apparatus and an image forming apparatus.

2. Description of the Related Art

A postprocessing apparatus transports a print sheet to a processing tray after printing by a print engine, and performs a predetermined postprocess for the print sheet put on the processing tray. The postprocessing apparatus includes a registration unit that performs registration of sheets on the processing tray (i.e. arranging plural accumulated sheets such that ends of the sheets are aligned), and swings a holder that the registration unit is attached and thereby retracts the registration unit to a position that the registration unit does not make contact with a print sheet in transportation to the processing tray when the print sheet is transported to the processing tray. Further, in the postprocessing apparatus, the processing tray is slanted, a stopper guide with which an end of a print sheet makes contact is installed at a lower end part of the processing tray in order to align print sheets on the processing tray.

It is supposed that in the postprocessing apparatus as mentioned, in addition to the registration mechanism, a guide mechanism is installed to cause an end of a print sheet (an end that should make contact with the stopper guide) to smoothly make contact with the stopper guide when the registration member moves the print sheet toward the stopper guide.

In such a case, the guide mechanism guides the print sheet after starting the movement of the print sheet toward the stopper guide by the registration mechanism, and therefore, it is required that the guide mechanism is operated with a delay from the registration mechanism. Consequently, it is supposed that the registration mechanism and the guide mechanism are operated individually by driving devices such as motors, and in such a case, plural driving devices are required and much cost is required for the postprocessing apparatus.

SUMMARY

A postprocessing apparatus according to an aspect of the present disclosure includes a processing tray on which a print sheet as a target of a postprocess is put, a stopper guide with which the print sheet on the processing tray makes contact, an intermediate roller, a registration mechanism, a guide mechanism, a driving device of the registration mechanism, and a transmission mechanism. The intermediate roller is configured to transport the print sheet. The registration mechanism is configured to move the incoming print sheet transported by the intermediate roller onto the processing tray and align print sheets on the processing tray.

The guide mechanism is configured to guide the print sheet moved by the registration mechanism toward the stopper guide. The transmission mechanism is configured to transmit driving force of the driving device to the guide mechanism with a delay.

An image forming apparatus according to an aspect of the present disclosure includes the aforementioned postprocessing apparatus, and supplies a print sheet after printing to the post processing apparatus.

These and other objects, features and advantages of the present disclosure will become more apparent upon reading of the following detailed description along with the accompanied drawings.

DETAILED DESCRIPTION

Hereinafter, embodiments according to an aspect of the present disclosure will be explained with reference to drawings.

Embodiment 1

Figure 1:
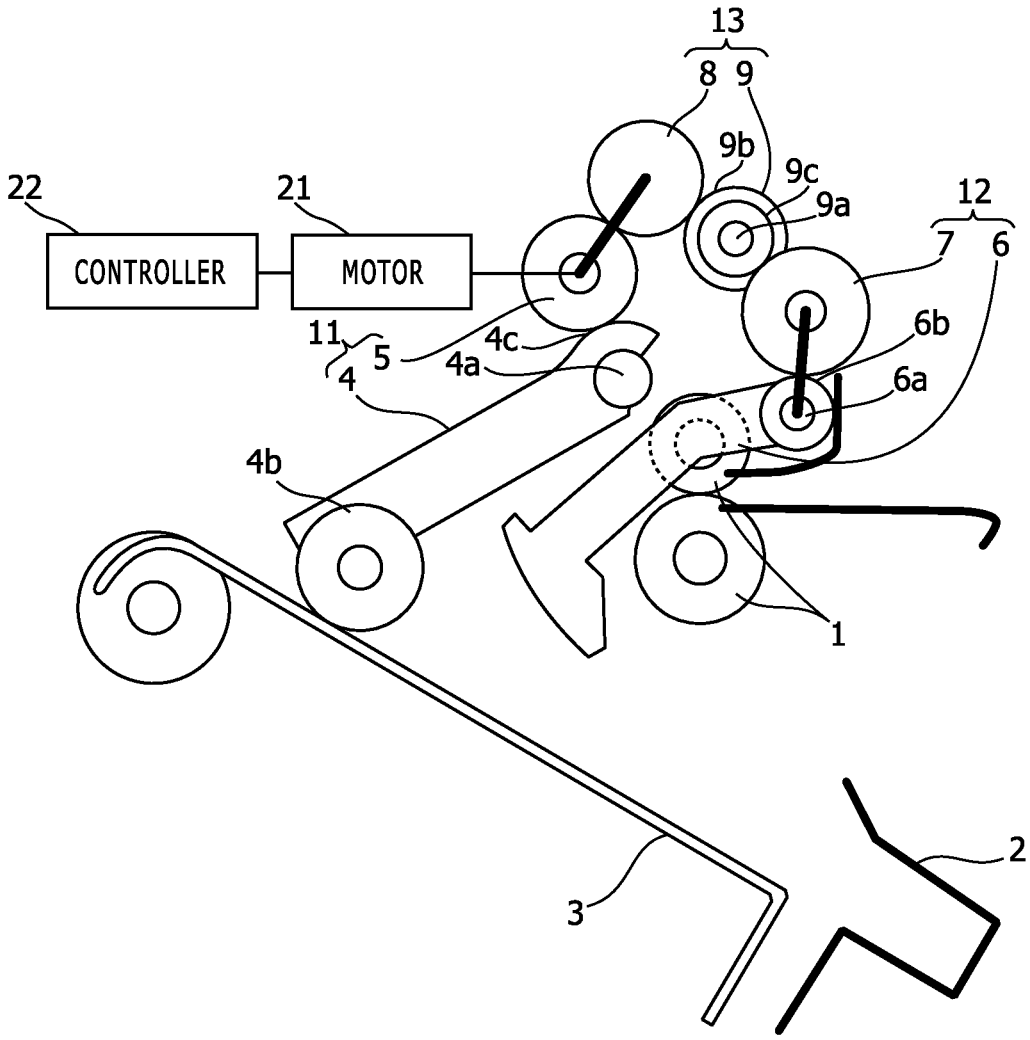
FIG. 1 shows a side-view diagram that indicates a configuration of a postprocessing apparatus according to Embodiment 1 of the present disclosure.

FIG. 1 shows a side-view diagram that indicates a configuration of a postprocessing apparatus according to Embodiment 1 of the present disclosure. The postprocessing apparatus shown in FIG. 1 may be an apparatus of a single body or may be built in an image forming apparatus such as multi function peripheral; and the postprocessing apparatus is supplied a print sheet after printing by a print engine, and performs a predetermined postprocess (e.g. staple process or the like) for the print sheet.

As shown in FIG. 1, the postprocessing apparatus in Embodiment 1 includes an intermediate roller 1, a stopper guide 2, a processing tray 3, a holder 4, a driving roller 5, a sheet contact member 6, a driven roller 7, a driven roller 8, a reduction roller 9, a motor 21, and a controller 22.

The intermediate roller 1 transports a print sheet as a target of the postprocess to a position over the processing tray 3. The intermediate roller 1 is driven by an unshown motor or the like.

The stopper guide 2 is arranged on an end side of the processing tray 3, and receives contact of a print sheet on the processing tray 3.

The processing tray 3 is a member of a slanted planer shape, and an incoming print sheet in transportation is put on the processing tray 3. For a print sheet put on the processing tray 3, the postprocess (e.g. stable process or the like) is performed.

The holder 4 is a member that is enabled to swing around an axis 4*a* as a swinging center at a certain end side of the holder 4, and has a registration roller 4*b* that makes contact with the print sheet at the other end side of the holder 4.

The driving roller 5 makes contact with an outer circumferential surface 4*c* of a rounded shape of the holder 4 at the certain end side, and is rotated by driving force of the motor 21. The holder 4 is swung by the rotation of the driving roller 5.

The holder 4 and the driving roller 5 act as a registration mechanism 11 that moves the incoming print sheet transported by the intermediate roller 1 onto the processing tray 3 and aligns print sheets on the processing tray 3.

The sheet contact member 6 is a member that is enabled to swing around an axis 6*a* as a swinging center at a certain end side of the member 6, and makes contact with an incoming print sheet moved by the registration mechanism 11. The driven roller 7 makes contact with an outer circumferential surface 6*b* of a rounded shape of the sheet contact member 6 at the certain end side of the sheet contact member 6, and is rotated by driving force transmitted by a transmission mechanism 13 mentioned below, and thereby causes the sheet contact member 6 to swing.

The sheet contact member 6 and the driven roller 7 act as a guide mechanism 12 that guides a print sheet moved by the registration mechanism 11 toward the stopper guide 2.

The driven roller 8 is a roller that makes contact with the driving roller 5 and the reduction roller 9 and transmits rotation force of the driving roller 5 to the reduction roller 9.

Figure 2:
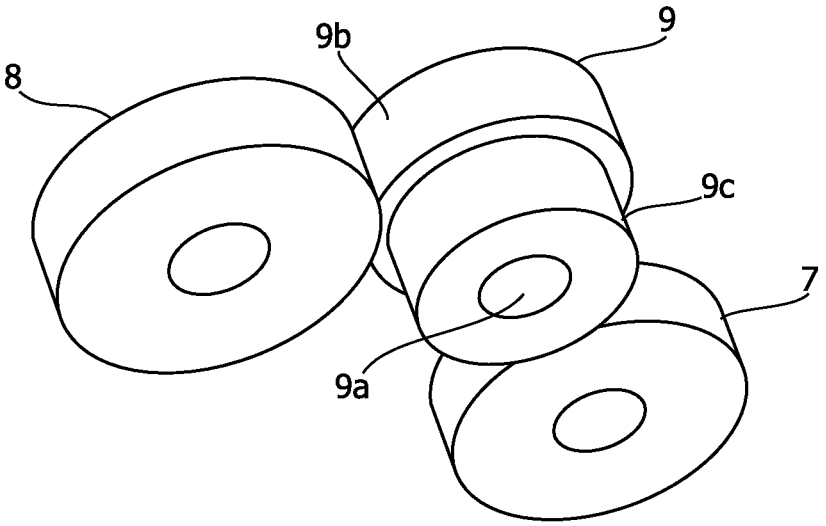
FIG. 2 shows a perspective-view diagram that indicates an example of a reduction roller 9 shown in FIG. 1.

FIG. 2 shows a perspective-view diagram that indicates an example of the reduction roller 9 shown in FIG. 1. The reduction roller 9 is a roller that is enabled to rotate around an axis inserted to a center hole 9*a*, and is a two-stage roller that makes a rotation angle of the driven roller 7 smaller than a rotation angle of the driving roller 5; and as shown in FIG. 2, the driven roller 8 makes contact with a large-diameter first stage roller part 9*b* of the roller 9 and the driven roller 7 makes contact with a small-diameter second stage roller part 9*c* of the roller 9.

The driven roller 8 and the reduction roller 9 act as a transmission mechanism 13 that transmits driving force of the motor 21 to the guide mechanism 12 with a delay. Therefore, correspondingly to a rotation angle of the motor 21, the transmission mechanism 13 makes a swinging angle of the sheet contact member 6 smaller than a swinging angle of the holder 4 and thereby the sheet contact member 6 acts with a delay.

The motor 21 is a driving device of the registration mechanism 11. The controller 22 controls the motor 21 and thereby causes the registration mechanism 11 and the guide mechanism 12 to act.

Further, the controller 22 counts the number of incoming print sheets transported by the intermediate roller 1 (i.e. the number of print sheets put on the processing tray 3), and adjusts a swinging angle of the holder 4 by the driving roller 5 correspondingly to the number of print sheets put on the processing tray 3. When the number of print sheets put on the processing tray 3 increases, the thickness of a bunch of the print sheets put on the processing tray 3 increases, and therefore, a swinging angle of the holder 4 by the driving roller 5 is decreased and thereby a gap between the registration roller 4*b* and the processing tray 3 after swinging of the holder 4.

Figure 3:
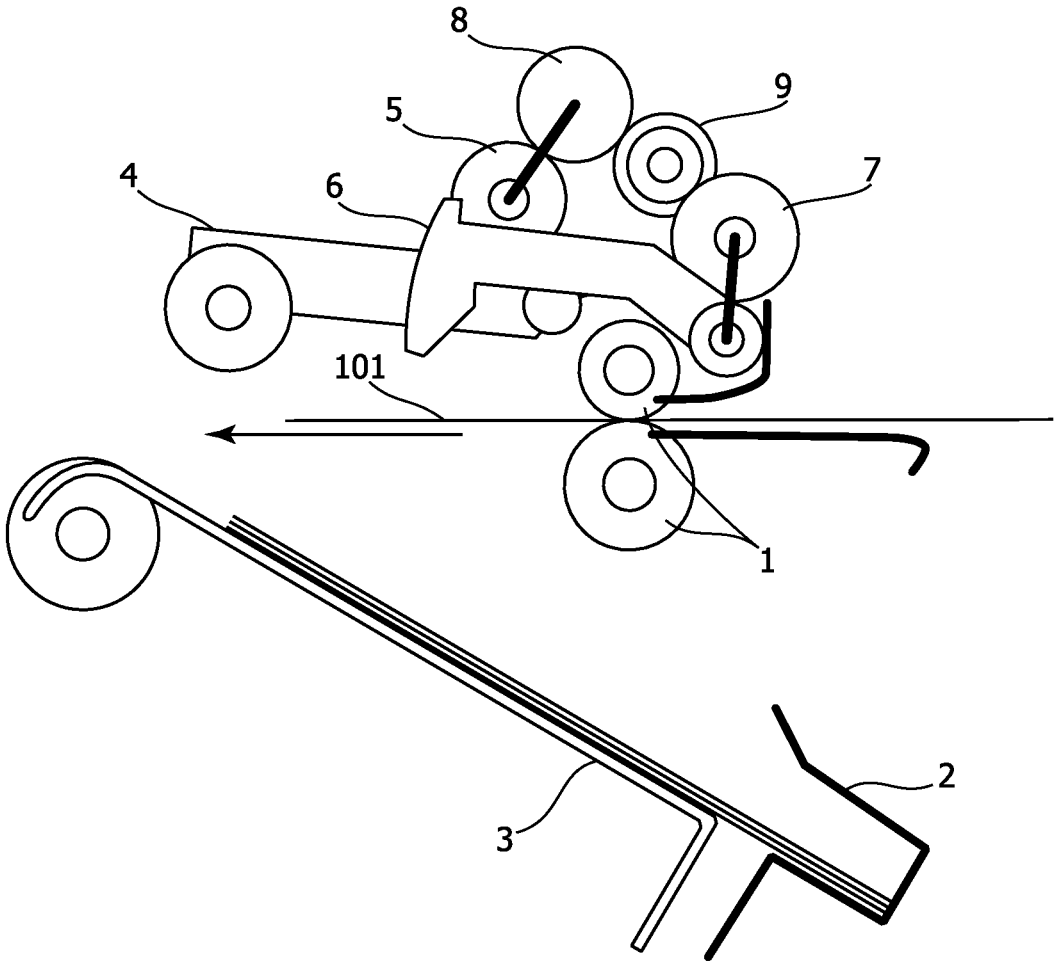
FIG. 3 shows a side-view diagram that explains a retracting behavior of the postprocessing apparatus shown in FIG. 1.
Figure 4:
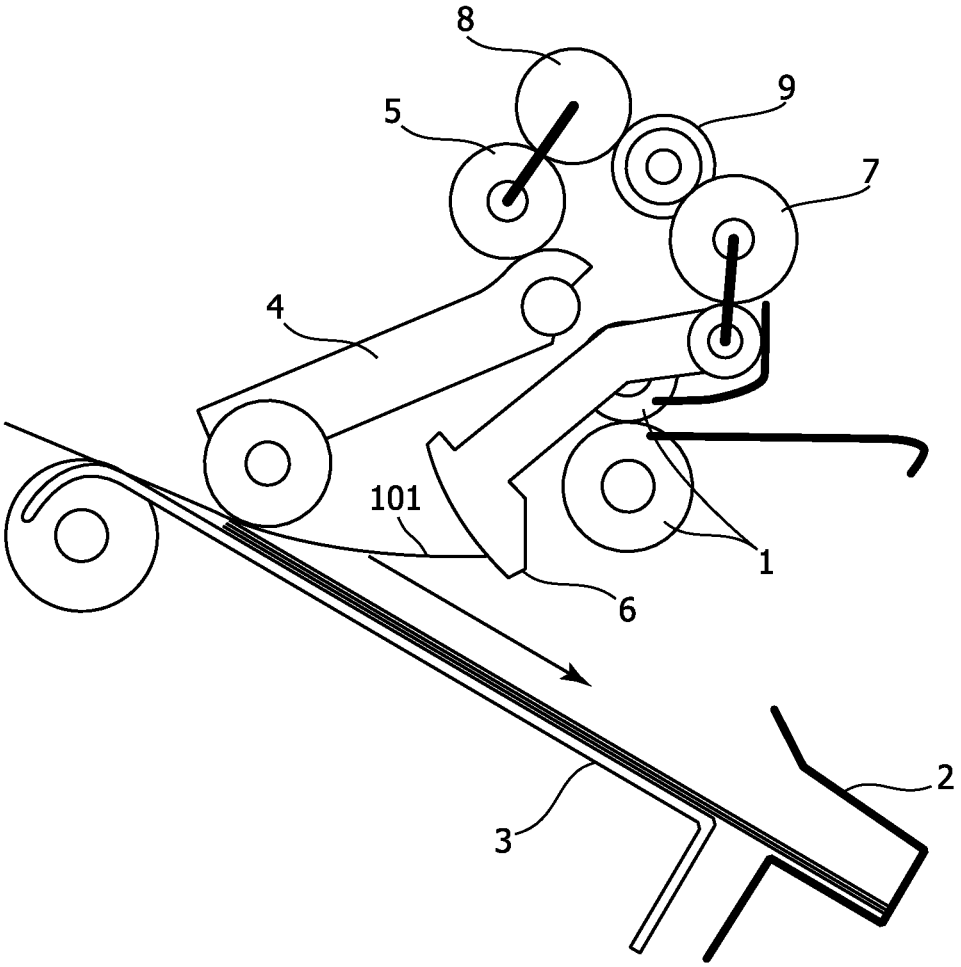
FIG. 4 shows a side-view diagram that explains a registration behavior of the postprocessing apparatus shown in FIG. 1.

The following part explains a behavior of the postprocessing apparatus in Embodiment 1. FIG. 3 shows a side-view diagram that explains a retracting behavior of the postprocessing apparatus shown in FIG. 1. FIG. 4 shows a side-view diagram that explains a registration behavior of the postprocessing apparatus shown in FIG. 1.

Before a print sheet after printing is transported to the intermediate roller 1 from a transportation device (not shown) as the prior stage, as shown in FIG. 3 for example, firstly the controller 22 controls the motor 21 and thereby causes the registration mechanism 11 and the guide mechanism 12 to act and retracts the holder 4 and the sheet contact member 6 such that the holder 4 and the sheet contact member 6 do not make contact with an incoming print sheet 101 in transportation.

Afterward, when the print sheet 101 separates from the intermediate roller 1, the controller 22 controls the motor 21 and thereby causes the registration mechanism 11 and the guide mechanism 12 to act, and as shown in FIG. 4 for example, causes the holder 4 to swing and thereby causes the registration roller 4*b* to make contact with the print sheet 101 and move the print sheet 101 toward the stopper guide 2, and with a delay from the registration roller 4*b*, causes the sheet contact member 6 to make contact with the print sheet 101 and thereby causes the sheet contact member 6*b* to make contact with the print sheet 101 and guide the print sheet 101 toward the stopper guide 2. The print sheet 101 makes contact with the stopper guide 2 and is piled up because the processing tray 3 is slanted to the vertical direction.

As mentioned, in the postprocessing apparatus in Embodiment 1, installed are the processing tray 3 on which a print sheet is put as a target of a postprocess, the stopper guide 2 with which the print sheet on the processing tray 3 makes contact, and the intermediate roller 1 that transports the print sheet; and the registration mechanism 11 moves the incoming print sheet transported by the intermediate roller 1 onto the processing tray 3 and aligns the print sheets on the processing tray 3. Further, the guide mechanism 12 guides the print sheet moved by the registration mechanism 11 toward the stopper guide 2. Furthermore, the motor 21 drives the registration mechanism 11, and the transmission mechanism 13 transmits driving force of the motor 21 to the guide mechanism 12 with a delay.

Consequently, driving force of the driving device (the motor 21) for the registration mechanism 11 is transmitted by the transmission mechanism 13 to the guide mechanism 12 that performs the delayed action, and therefore, it is not required to add a driving device for the guide mechanism 12, and cost increase of the postprocessing is restrained and the registration of a print sheet is smoothly performed.

Embodiment 2

Figure 5:
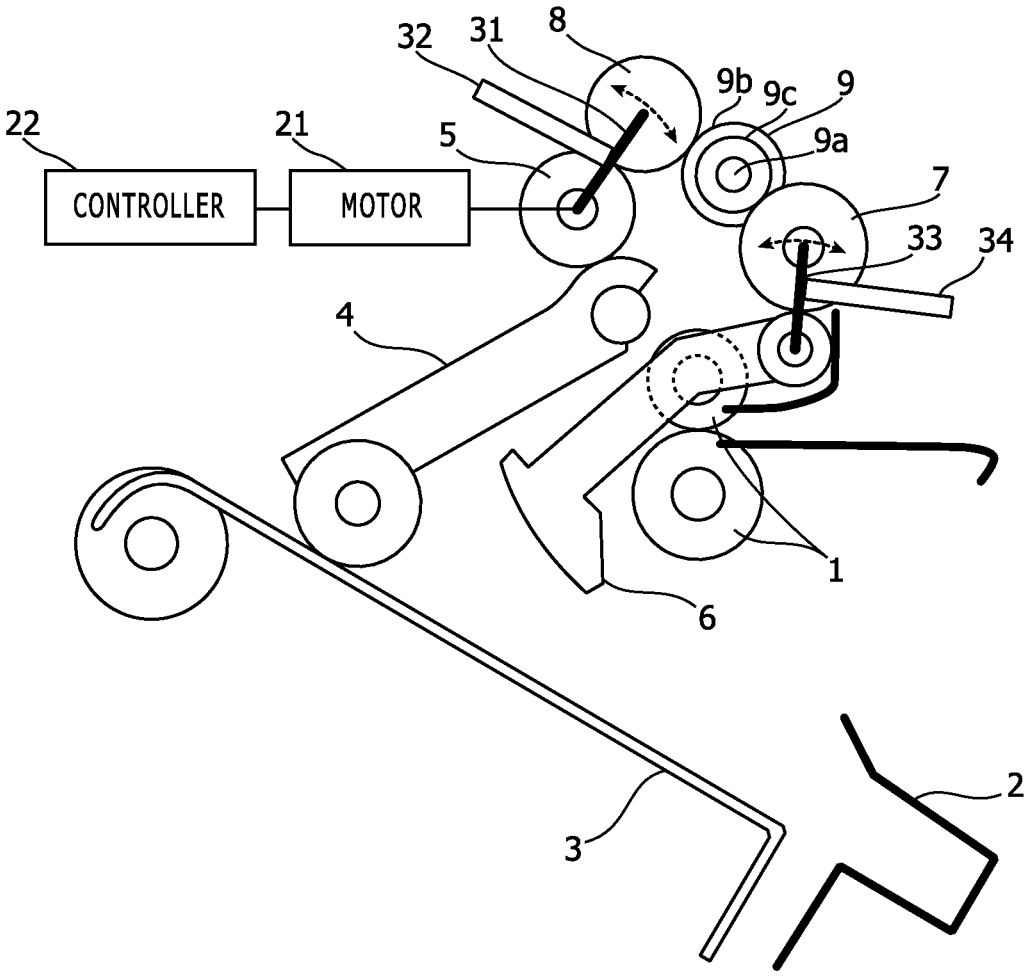
FIG. 5 shows a side-view diagram that indicates a configuration of a postprocessing apparatus according to Embodiment 2 of the present disclosure.
Figure 6:
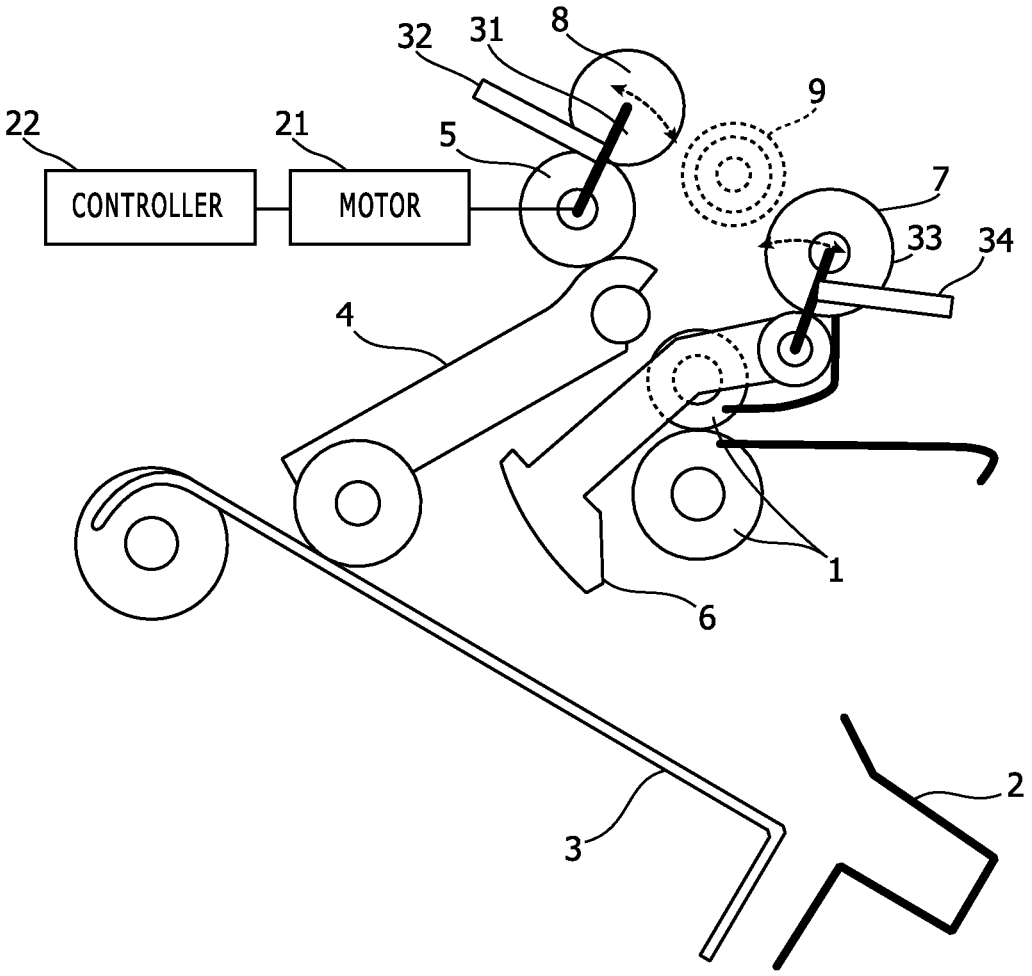
FIG. 6 shows a diagram that explains exchange of the reduction roller in the postprocessing apparatus in Embodiment 2 (1/3)
Figure 7:
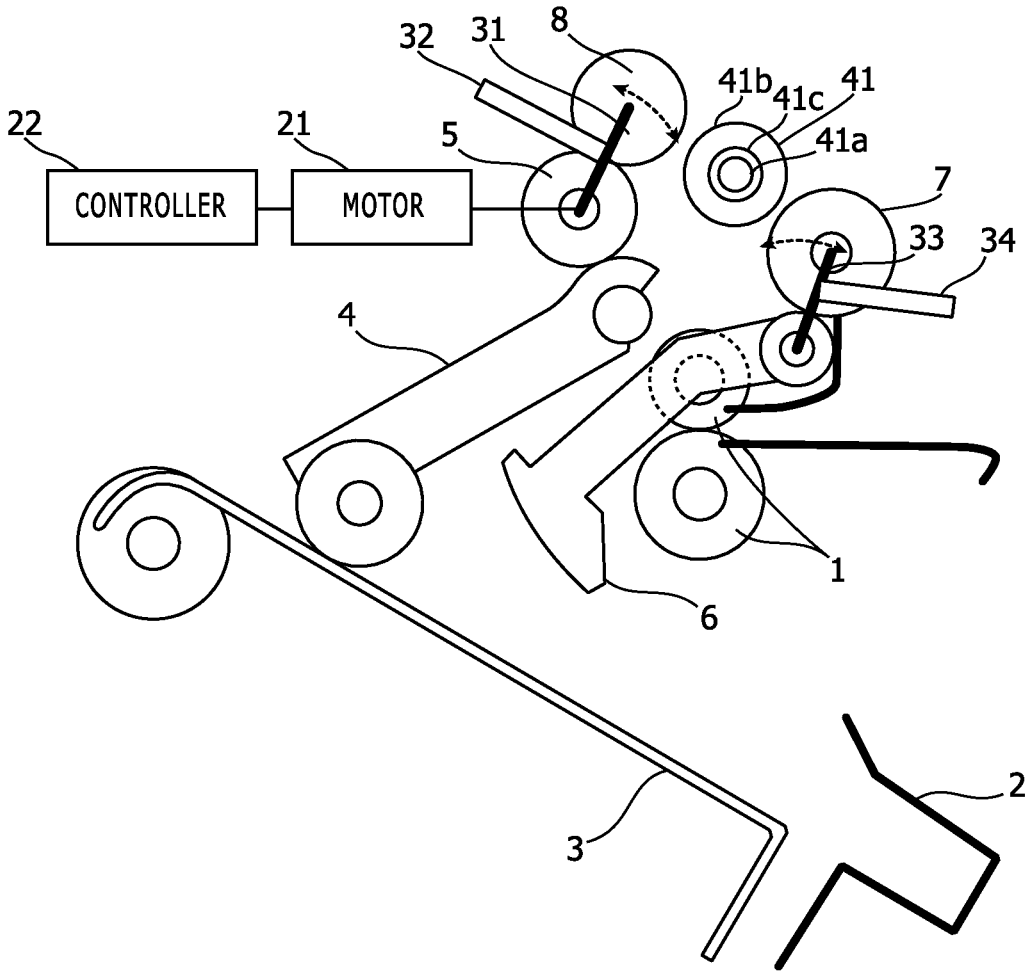
FIG. 7 shows a diagram that explains exchange of the reduction roller in the postprocessing apparatus in Embodiment 2 (2/3)
Figure 8:
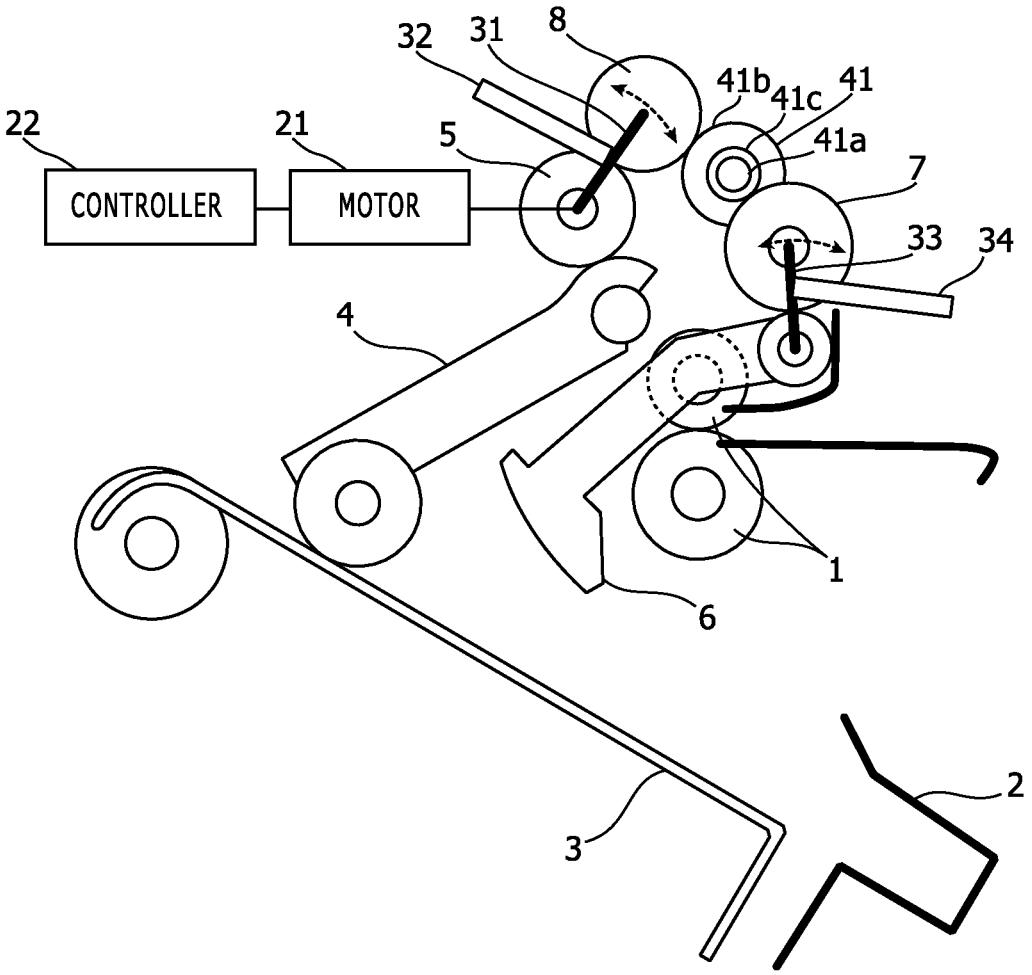
FIG. 8 shows a diagram that explains exchange of the reduction roller in the postprocessing apparatus in Embodiment 2 (3/3).

FIG. 5 shows a side-view diagram that indicates a configuration of a postprocessing apparatus according to Embodiment 2 of the present disclosure. FIGS. 6 to 8 show diagrams that explain exchange of the reduction roller in the postprocessing apparatus in Embodiment 2. As shown in FIG. 5, the postprocessing apparatus in Embodiment 2 further includes supporting members 31 and 33, and elastic members 32 and 34.

An end of the supporting member 31 connects to an axis of the driving roller 5 such that the supporting member 31 is enabled to swing and the other end of the supporting member 31 connects to a rotation axis of the driven roller 8; and the supporting member 31 supports the driven roller 8 such that the driven roller 8 is enabled to rotate. The elastic member 32 is a stretchable member such as spring, and pushes the supporting member 31 toward a direction to the reduction roller 9 and thereby presses the driven roller 8 against the reduction roller 9. When exchanging the reduction roller 9, the elastic member 32 is expanded or shrunk (here, shrunk) to an opposite direction to a direction to the reduction roller 9 by a manual operation of an operator or the like, and thereby the driven roller 8 is separated from the reduction roller 9.

An end of the supporting member 33 connects to an axis of the axis 6*a* such that the supporting member 33 is enabled to swing and the other end of the supporting member 33 connects to a rotation axis of the driven roller 7; and the supporting member 33 supports the driven roller 7 such that the driven roller 7 is enabled to rotate. The elastic member 34 is a stretchable member such as spring, and pushes the supporting member 33 toward a direction to the reduction roller 9 and thereby presses the driven roller 7 against the reduction roller 9. When exchanging the reduction roller 9, the elastic member 34 is expanded or shrunk (here, shrunk) to an opposite direction to a direction to the reduction roller 9 by a manual operation of an operator or the like, and thereby the driven roller 7 is separated from the reduction roller 9.

Further, in Embodiment 2, the reduction roller 9 is detachable from the center axis, and can be exchanged with another reduction roller (for example, a reduction roller of a different reduction ratio from a reduction ratio of the reduction ratio 9).

In a status that the reduction roller 9 is in use, for example as shown in FIG. 5, elastic recovery force by the elastic members 32 and 34 cause the driven rollers 7 and 8 to be pressed against the reduction roller 9 and a rotation force of the driven roller 8 is transmitted to the driven roller 7 through the reduction roller 9.

By a manual operation of an operator or the like, the elastic members 32 and 34 are expanded or shrunk to opposite directions to directions to the reduction roller 9, and thereby the driven rollers 7 and 8 is separated from the reduction roller 9, and then the reduction roller 9 is detached, as shown in FIG. 6, for example. Afterward, as shown in FIG. 7, for example, by a manual operation of an operator or the like, another reduction roller 41 is attached and the expansion or the shrink of the elastic members 32 and 34 by the manual operation is released. Consequently, as shown in FIG. 8, for example, elastic recovery force by the elastic members 32 and 34 cause the driven rollers 7 and 8 to be pressed against the reduction roller 41 and a rotation force of the driven roller 8 is transmitted to the driven roller 7 through the reduction roller 41.

Here, the reduction roller 41 is a roller that is enabled to rotate around an axis inserted to a center hole 41*a*, and is a two-stage roller that makes a rotation angle of the driven roller 7 smaller than a rotation angle of the driving roller 5; and as shown in FIG. 8, the driven roller 8 makes contact with a large-diameter first stage roller part 41*b* of the roller 41 and the driven roller 7 makes contact with a small-diameter second stage roller part 41*c* of the roller 41. Here, a diameter of the first stage roller part 41*b* is identical to a diameter of the first stage roller part 9*b*, and a diameter of the second stage roller part 41*c* is smaller than a diameter of the second stage roller part 9*c*.

Other parts of the configuration and behaviors of the postprocessing apparatus in Embodiment 2 are identical or similar to those in Embodiment 1, and therefore not explained here.

As mentioned, in Embodiment 2, the reduction roller can be exchanged by an easy manual operation, and an action delay of the sheet contact member 6 from an action of the holder 4 can be easily adjusted.

It should be understood that various changes and modifications to the embodiments described herein will be apparent to those skilled in the art. Such changes and modifications may be made without departing from the spirit and scope of the present subject matter and without diminishing its intended advantages. It is therefore intended that such changes and modifications be covered by the appended claims.

What is claimed is:

1. A postprocessing apparatus, comprising:

a processing tray on which a print sheet as a target of a postprocess is put;

a stopper guide with which the print sheet on the processing tray makes contact;

an intermediate roller configured to transport the print sheet;

a registration mechanism configured to move the incoming print sheet transported by the intermediate roller onto the processing tray and align print sheets on the processing tray;

a guide mechanism configured to guide the print sheet moved by the registration mechanism toward the stopper guide;

a driving device of the registration mechanism;

a transmission mechanism configured to transmit driving force of the driving device to the guide mechanism with a delay;

wherein the registration mechanism comprises of a holder having a registration roller, and a first roller configured to make contact with the holder, rotate by the driving force of the driving device and swing the holder;

the guide mechanism comprises a sheet contact member configured to make contact with an end of the print sheet, and a second roller configured to make contact with the sheet contact member, rotate by the transmission mechanism and swing the sheet contact member; and the transmission mechanism comprises a reduction roller configured to make a rotation angle of the second roller smaller than a rotation angle of the first roller.

2. The postprocessing apparatus according to claim 1, further comprising:

a third roller configured to make contact with the first roller and the reduction roller and transmit rotation force of the first roller to the reduction roller;

a first stretchable elastic member configured to press the third roller against the reduction roller; and a second stretchable elastic member configured to press the second roller against the reduction roller;

wherein the reduction roller is detachable.

3. The postprocessing apparatus according to claim 1, further comprising a controller configured to control the driving device;

wherein the controller adjusts a swinging angle of the holder by the first roller correspondingly to a number of print sheets put on the processing tray.

4. An image forming apparatus, comprising a postprocessing apparatus;

wherein a print sheet after printing is supplied to the post processing apparatus; and the postprocessing apparatus comprises:

a processing tray on which a print sheet as a target of a postprocess is put;

a stopper guide with which the print sheet on the print sheet makes contact;

an intermediate roller configured to transport the print sheet;

a registration mechanism configured to move the incoming print sheet transported by the intermediate roller onto the processing tray and align print sheets on the processing tray;

a guide mechanism configured to guide the print sheet moved by the registration mechanism toward the stopper guide;

a driving device of the registration mechanism;

a transmission mechanism configured to transmit driving force of the driving device to the guide mechanism with a delay;

wherein the registration mechanism comprises a holder having a registration roller, and a first roller configured to make contact with the holder, rotate by the driving force of the driving device and swing the holder;

the guide mechanism comprises a sheet contact member configured to make contact with an end of the print sheet, and a second roller configured to make contact with the sheet contact member, rotate by the transmission mechanism and swing the sheet contact member; and the transmission mechanism comprises a reduction roller configured to make a rotation angle of the second roller smaller than a rotation angle of the first roller.

* * * * *